United States Patent [19]

Breck, Jr.

[11] 4,385,571

[45] May 31, 1983

[54] AUTOMATIC BELT LOOP TACKER

[75] Inventor: Louis W. Breck, Jr., El Paso, Tex.

[73] Assignee: Billy The Kid, Inc., El Paso, Tex.

[21] Appl. No.: 254,455

[22] Filed: Apr. 15, 1981

Related U.S. Application Data

[63] Continuation-in-part of Ser. No. 76,085, Sep. 17, 1979, Pat. No. 4,287,842.

[51] Int. Cl.[3] ..... D05B 23/00

[52] U.S. Cl. ..... 112/121.27; 112/104

[58] Field of Search ..... 112/121.27, 121.26, 112/121.11, 121.12, 121.15, 113, 104

[56] References Cited

U.S. PATENT DOCUMENTS

| | | | |
|---|---|---|---|
| 3,095,842 | 7/1963 | Metzger | 112/121.27 |
| 3,980,033 | 9/1976 | Frost et al. | 112/121.27 X |
| 4,005,663 | 2/1977 | Barthelmes | 112/121.27 X |
| 4,048,931 | 9/1977 | Hodgins | 112/104 X |
| 4,114,544 | 9/1978 | Miyschi et al. | 112/104 |
| 4,137,857 | 2/1979 | Miyachi et al. | 112/121.27 |

*Primary Examiner*—H. Hampton Hunter

*Attorney, Agent, or Firm*—Kramer and Brufsky

[57] ABSTRACT

Sewing apparatus for automatically feeding individual belt loops to a folding mechanism where opposite transverse ends of each of the belt loops is folded back upon itself. The loops are then delivered in tandem to a tacker where the folded ends are automatically stitched to a garment.

10 Claims, 14 Drawing Figures

212
274
276
270
258
264
266
268
240
256
200
262
254
244
252
84
206
250
75
244
71
73
84
108
102
80
12
12
114
307
109
116
110
N
118
108
274
246

AUTOMATIC BELT LOOP TACKER

CROSS-REFERENCE TO RELATED APPLICATION

This application is a continuation-in-part of application of Ser. No. 6/076,085, filed Sept. 17, 1979 now U.S. Pat. No. 4,287,842 dated Sept. 8, 1981.

TECHNICAL FIELD

This invention relates to sewing apparatus, and more particularly, apparatus for delivering, folding and stitching belt loops to a garment.

PRIOR ART

Heretofore, it was common for belt loops to be sewn directly to the outside of work clothes, such as jeans. The individual loops were taken by a sewing machine operator, folded at opposite longitudinal ends, and stitched on their outside to the jeans. The manual handling of the individual loops and positioning of the same on the jeans is a time-consuming, production-reducing process. The apparatus of the present invention delivers the belt loops, folds them at their opposite longitudinal ends, and stitches them to the outside of the garment at the opposite longitudinally folded ends, all automatically, thereby reducing valuable production time and operator tedium associated with sewing belt loops to a garment.

In my prior patent, U.S. Pat. No. 4,034,690, issued July 12, 1977, entitled "Apparatus and Method for Forming Belt Loops", I disclose an apparatus and method for making belt loops from discrete, pre-sized plies of fabric material. The loops are collated in a bundle or spool so that they can be removed and sewn to garment pieces cut from adjacent areas on a fabric lay to maintain the same shading characteristics of the component pieces of the garment throughout its construction. The apparatus and method for collating and bundling the belt loops is disclosed in my prior patents, U.S. Pat. No. 4,149,709 issued Apr. 17, 1979, entitled "Apparatus and Method for Collating and Bundling Belt Loops" and U.S. Pat. No. 4,135,707 issued Jan. 23, 1979, also entitled "Apparatus and Method for Collating and Bundling Belt Loops".

The present apparatus is specifically adapted to remove the individual belt loops from the collated spool bundle, deliver them to a folder which folds their opposite ends, and then sews them to the exterior of a garment. While the apparatus is specifically adapted to operate with such a spool bundle, it will be obvious from the following disclosure that the apparatus can be used to deliver, fold and stitch any discrete one or more belt loops to a garment such as a pair of jeans, regardless of their source and the manner in which they are formed. To illustrate this, an alternative apparatus for feeding the loops serially in single file, or back-to-back tandem relationship to the folder is also disclosed.

SUMMARY OF THE INVENTION

In one form of the invention the apparatus includes a conveyor handling section for feeding individual loops to a folder and a sewing head. A spool bundle of belt loops is loaded onto a reel positioned above the conveyor, which comprises an endless belt. The spool includes a thread which is used to unwind the spool and deposit the loops wound on the spool onto the conveyor belt at spaced locations. The thread on the spool is fed down the middle of the conveyor belt and underneath the conveyor, through a loop guide which turns it ninety degrees, and is then wound upon a motorized spindle. Turning of the spindle pulls the thread and unwinds the loops from the spool and causes them to seat upside down at spaced locations on the conveyor belt.

The conveyor feeds the loops past a guide member mounted on the front of the conveyor which causes the individual loops on the conveyor to be serially turned right side up and deposited on a reciprocable L-shaped slide mounted beneath the conveyor. The L-shaped slide is provided with channel-shaped transverse ends. As each loop is deposited on the slide, a microswitch is activated, stopping the motorized spindle. At the desired time, the slide moves forward into mating engagement with a plastic block having an open front and open transverse ends. The slide, upon mating with the block, closes the front of the block forming a housing for the loop deposited on the slide. A pulse of air is then transmitted transversely through the channel ends of the slide and housing enclosure formed by the block and slide, or ninety degrees to the direction of movement of the slide, to move the loop and complete its delivery to a folding mechanism.

The loop is blown through the channel formed in one transverse end of the housing onto a platform on one end of a slidable plate, reciprocably mounted in a support plate. A cam-actuated folding mechanism then folds each transverse end of the individual belt loop back upon itself.

The folding mechanism includes a cam plate reciprocably movable in a slot on the slidable plate by an air cylinder mounted beneath the plate. The cam plate has a pair of elongated spiral slots each of which receives a cam follower mounted on an elongated rod. The rods are parallel to each other and have a folder at one end. The opposite end of each rod is mounted on an upright block fixed to the slidable plate in the support plate. Movement of the cam plate forwardly by the piston of the air cylinder causes rotation of the relatively stationary rods via the camming action between the cam followers on each rod and the camming slots on the movable cam plate. This causes downwardly projecting fingers on the end of each folder to pivot inwardly about the belt loop to turn each end of the belt loop on the platform in front of the folding mechanism back upon itself.

Continued forward movement of the cam plate will cause it to contact a stop positioned in the slot in the slidable plate in front of the cam plate. This stop is connected to the slideable plate so that continued movement of the air cylinder piston will cause the entire folder mechanism supported on the slidable plate to move forwardly along with the cam plate. This causes the platform holding the folded belt loop forward and the loop is deposited beneath the foot of a sewing head or tacker. A clamp associated with the tacker is pivoted downwardly to clamp the folded belt loop beneath the foot of the tacker.

The motion of the air cylinder associated with the folding mechanism is then reversed. This causes the cam plate to reverse its direction of movement and retract. Retraction of the cam plate in the slot in the slidable plate first causes the rods holding the folder fingers to rotate back to their initial position, through the camming action between the followers on the relatively stationary rods and spiral slots on the relatively movable cam plateresulting in dropping of the loop. Continued rearward movement of the cam plate in the slot in the slidable plate causes the cam plate to strike a second stop in the rear of the slot in the slidable plate to then move the slidable plate and folder mechanism assembly back to its initial position to receive another belt loop.

One transverse end of the loop is then sewn or tacked to a garment positioned beneath the sewing head or tacker. After this sewing operation is completed, a second air cylinder associated with the tacker has its piston moved horizontally to move the loop and its entire support platform beneath the foot of the tacker forwardly, to reposition the opposite transverse end of the loop beneath the sewing head of the tacker. The opposite transverse end of the loop is then sewn to the garment.

The downwardly pivotable clamp is then released so that the garment can be removed from beneath the tacker with the sewn loop in it and repositioned to receive the next loop. The platform associated with the tacker is then retracted by the horizontal air cylinder associated with the tacker to be realigned with the folder so as to be in a position to receive a subsequent loop for tacking to the garment.

In an alternate form of the invention, a series of loops overlapped and sewn end-to-end are fed in stepped increments onto the reciprocable platform on one end of the slidable plate of the folding mechanism. The subsequent folding and sewing operations are identical to that described above.

The alternate feeding mechanism includes an endless belt having an upper run in contact with the string of sewn, end-to-end loops which are initially placed manually in contact with the upper run of the belt between the upper run and a spring-biased clamp plate. The belt is entrained about opposed pairs of upper and lower fixed rollers provided with one-way clutches so that they only turn in the direction of feeding of the belt and belt loops.

A pair of movable rollers are in contact with the belt intermediate its upper and lower runs defined by the opposed pairs of upper and lower rollers. Each of the movable rollers are mounted on one end of a pivotable arm, which arms are connected by a stiff spring so that they move together in parallel relation.

The opposite end of one of the parallel arms is connected to the piston of an air cylinder. Upon extension of the piston of the air cylinder, the upper portion of the arms and movable rollers are oscillated in a counterclockwise direction; the movable roller nearest the forward end of the belt pulling the upper run of the endless belt about the upper pair of opposed rollers which feed the belt and a belt loop in contact therewith along its length forwardly onto the reciprocable platform on one end of the slidable plate of the folding mechanism. Simultaneously a knife is pivoted to sever the loop from the end-to-end string. The rearmost movable roller maintains tension on the intermediate portion of the belt as the upper run is fed. The lower run of the endless belt remains stationary as the lower rollers cannot turn in the direction of force applied by the oscillating forward movable roller. In essence, therefore, the belt portion between the rear, opposed upper, and forward rollers is moved upon extension of the piston.

Upon retraction, or the return stroke of the piston, only the lower run of the belt is advanced; the upper run and a subsequent loop to be fed remaining stationary while the loop delivered to the reciprocable feed plate is folded and delivered to the sewing head.

Upon retraction of the piston, the upper portion of the arms are oscillated in a clockwise direction; the rearmost movable roller pulling the lower run of the belt about the lower pair of opposed uni-directional turning rollers. The forward movable roller maintains tension on the intermediate portion of the belt as the lower run is fed. The upper run of the endless belt remains stationary as the opposed pair of upper rollers cannot turn in the direction of force applied by the oscillating rear roller. The belt portion between the rear, opposed lower, and forward rollers is thus only moved upon retraction of the piston, providing an effective lost-motion or intermittently operated feed mechanism for the belt loops.

The roller and belt feed mechanism enables a positive feed of individual loops to be accomplished, as the upper run of the belt is in free surface contact with each loop along the whole loop surface as it is fed forwardly. Moreover, the mechanism provides a mechanical advantage of 2:1 or one inch of piston movement results in two inches of belt movement. This enables the feed apparatus to be more compact as space requirements are severely restricted.

BRIEF DESCRIPTION OF THE DRAWINGS

Further objects and advantages of the invention will become apparent from the following description and claims, and from the accompanying drawings, wherein:

DETAILED DESCRIPTION

Figure 1:
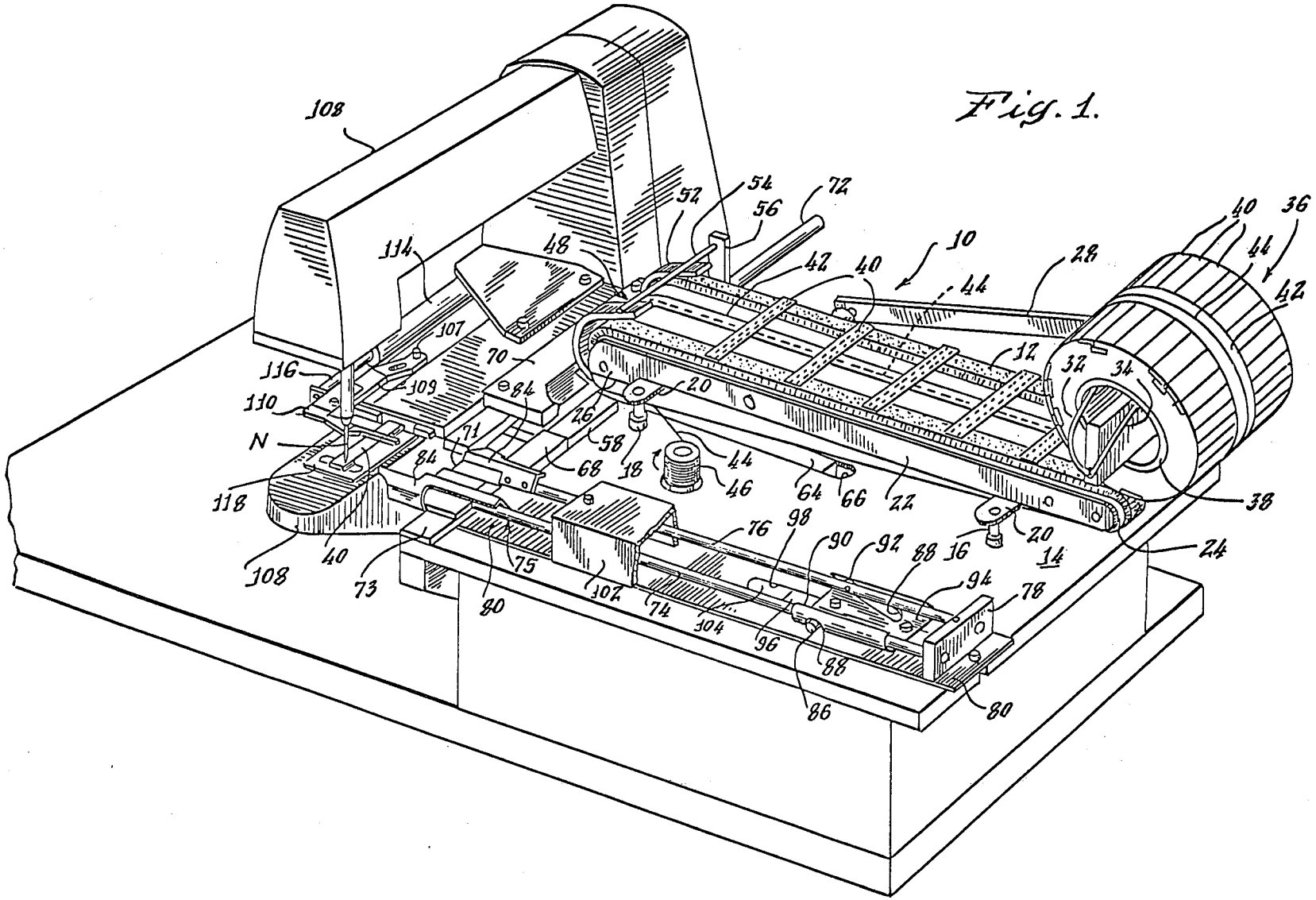
FIG. 1 is a perspective view of one embodiment of the automatic belt loop tacker apparatus of the present invention.

Referring now to the drawings in detail, wherein like numerals indicate like elements throughout the several views, one form of the automatic belt loop tacker apparatus of the present invention is indicated in FIG. 1 by the numeral 10.

Apparatus 10 includes an endless conveyor belt 12 supported in spaced relation above a main support plate 14 by a plurality of threaded posts 16 and 18. The posts 16 and 18 are received in ears 20 connected to a rectangular frame 22 for the conveyor belt 12. Endless conveyor belt 12 is entrained about rollers 24 and 26 connected to the opposite ends of the rectangular framework 22.

An arm 28 is pivotably mounted on framework 22 and carries a spool support at its opposite end consisting of a block 30 mounting a pair of spring fingers 32 and 34 which form a V-shaped configuration when viewed in side elevation. A spool of belt loops wound on a core 38 is inserted over the V-shaped spring fingers 32 and 34 which retains them on arm 28 above the surface of conveyor belt 12.

The individual belt loops 40 on spool 36 are retained wound about core 38 between a tape 42 and a thread 44. When the spool 36 is placed upon the spring fingers 32 and 34, the thread 44 is unwound and run down the center of the conveyor. The thread 44 is positioned beneath the conveyor and enters a guide (not shown) which bends it at an angle. The end of the thread 44 is wound about a motorized spindle 46 which extends upwardly through support plate 14.

Rotation of the spindle in a clockwise direction as viewed in FIG. 1, will wind the thread 44 upon the spindle 46 at the same time unwinding the spool of belt loops 36 and depositing the individual loops in spaced relation along the top run of belt 12. The frictional contact between thread 44 and the top run of conveyor 12 causes the conveyor 12 to move about idler rollers 24 and 26 on frame 22.

The individual belt loops 40 are deposited on the top run of conveyor 12 upside down. The conveyor 12 feeds each individual belt loop 40 past an angular guide member 48 consisting of a pair of arcuate fingers 50 and 52 at the front of the conveyor 12. The arcuate fingers 50 and 52 are connected together by a rod 54 mounted on an upright post 56 carried by one side member of frame 22. The guide fingers 50 and 52 cause each individual belt loop 40 to be turned right-side up about the front of conveyor 12 and deposited on an L-shaped plate 58 reciprocably slidable on support plate 14 by means of an air cylinder 60 mounted beneath the plate 14.

Air cylinder 60 has a piston 62 connected to a slide rod 64 slidable within an elongated slot 66 formed in plate 14 beneath conveyor belt 12. Slide rod 64 is connected at its opposite end to L-shaped slide plate 58 onto which each individual belt loop 40 is deposited. L-shaped slide plate 58 includes a channel member 68 at each end for a purpose which will be described hereinafter.

Figure 4:
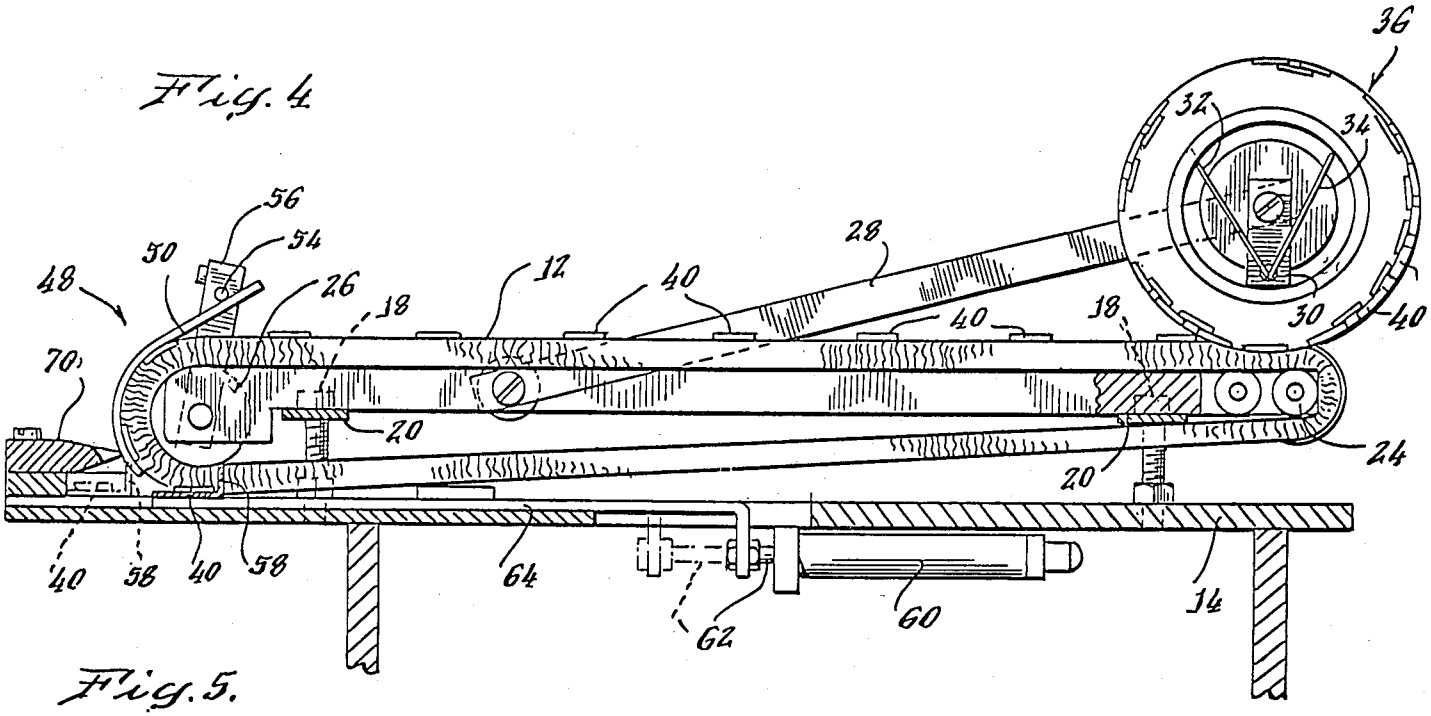
FIG. 4 is a cross-sectional view of the apparatus taken substantially along the plane indicated by line 4—4 of FIG. 3.

The deposit of the belt loop 40 from conveyor 12 onto the L-shaped slide plate 58 actuates a microswitch (not shown). The switch stops rotation of the motorized spindle. Air cylinder 60 is then actuated to move piston 62 forward as indicated in phantom lines in FIG. 4, sliding plate 58 forwardly towards a plastic block 70 mounted on the front end of plate 14. Slide plate 58 encloses the space between block 70 and the top support plate 14 so as to form with the block and support plate an enclosure having open lateral ends defined by opposed transverse channels 68 on slide plate 58.

When belt loop 40 is placed within the enclosure formed by block 70 and slide plate 58, a pulse of air is transmitted through a conduit 72 into the enclosure through one channel 68 to push the belt loop 40 laterally through the opposite channel 68 onto a support platform 73 mounted on the front of a slidable support plate 80 in main support 14, which carries a folder mechanism 75. The belt loop 40 is now positioned ready to have its transverse ends folded prior to being tacked to a garment.

Figure 7:
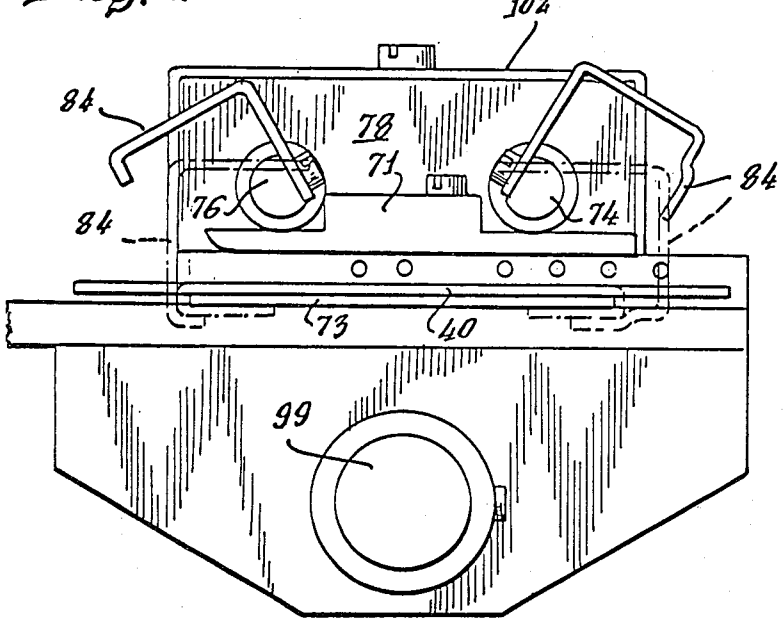
FIG. 7 is a cross-sectional view taken substantially along the plane indicated by line 7—7 of FIG. 5.
Figure 9:
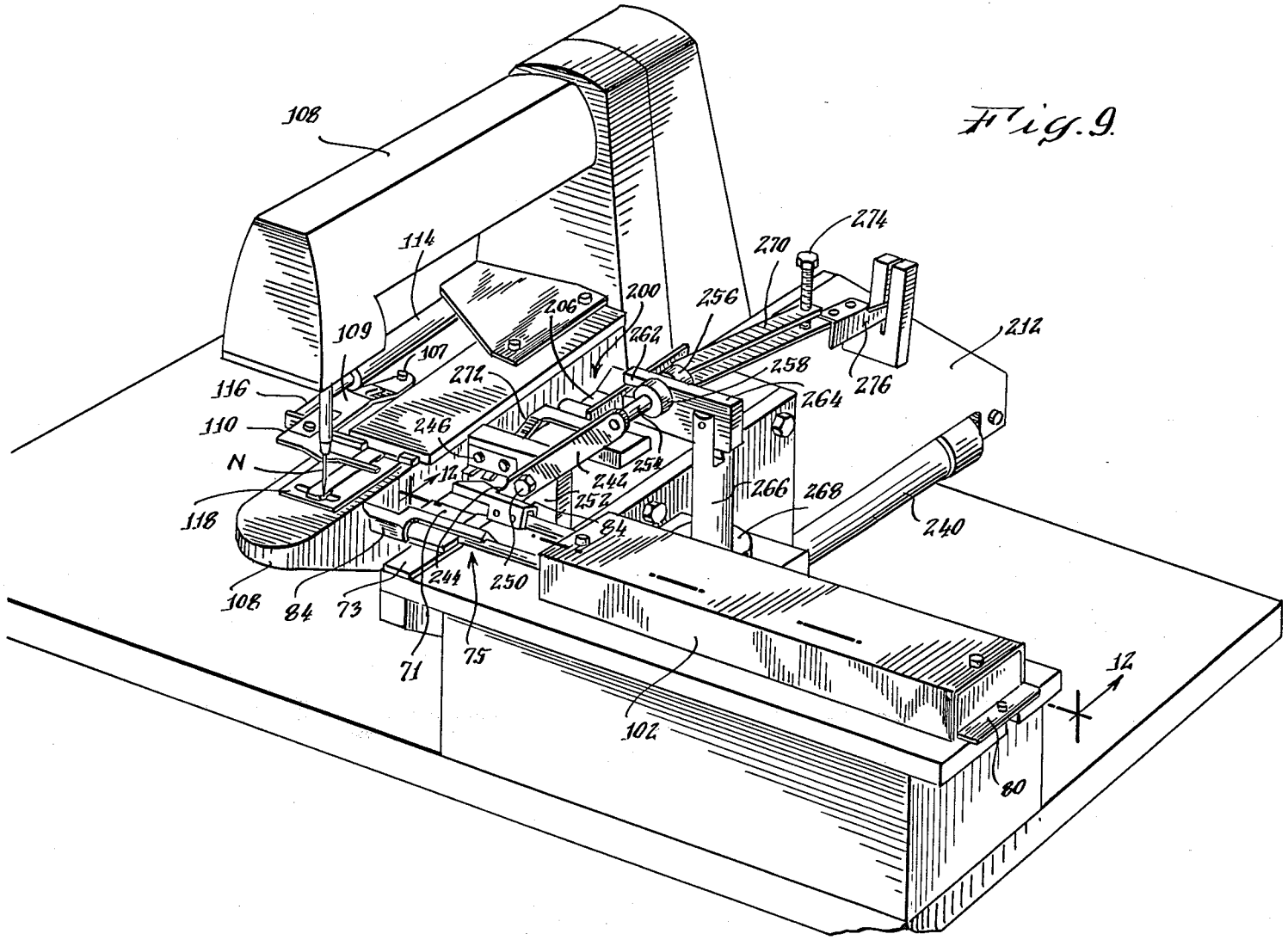
FIG. 9 is a perspective view of an alternate embodiment of the automatic belt loop tacker apparatus of the present invention.

The folder mechanism 75 includes a pair of parallel, spaced rods 74 and 76 fixed to a pair of spaced plates 78 on slide plate 80 of the lefthand side of support plate 14. Mounted on the forward end of each of the rods 74, 76 is a folder 84. Folder 84 includes a downwardly projecting substantially C-shaped plate for contact with opposite transverse ends of belt loops 40 supported on platform 73 to bend the ends of the belt loop back upon itself as illustrated in phantom in FIG. 7. In order to bend the belt loop 40 positioned on platform 73 back upon itself, the downardly projecting C-shaped plates 84 must be rotated in opposite directions about the axis of its respective mounting rod 74, 76.

In order to rotate the C-shaped plates 84 about the axis of each of the rods 74, 76, each of the rods carry a cam follower 86 adjacent its rear end. Cam followers 86 comprise stub shafts or pintles welded or otherwise fixed to each of the rods 74, 76 and are positioned in a spiral wound groove 88 cut in opposite flanges 90 and 92 of a substantially U-shaped cam plate 94 fixed to a slide rod assembly 96 slidable in a groove 98 formed in the slide plate 80 and support plate 14. Cam plate 94 and slide 96 are movable by an air cylinder 99 mounted beneath support plate 14 having a piston rod 100 connected to slide assembly 96. The cam plate 94, rods 74, 76 and support blocks 78 are housed within a shield 102.

Upon retraction of the piston rod 100 of air cylinder 99, cam plate 94 and slide rod assembly 96 is moved forwardly in slot 98. Movement of the cam plate 94 in a forward direction causes cam follower pintles 86 on relatively stationary rods 74, 76 to travel rearwardly along spiral slots 88 in the flanges 90and 92, respectively, in cam plate 94, which will rotate rod 76 in a counterclockwise direction and rod 74 in a clockwise direction, as viewed in FIG. 7, causing the downwardly projecting C-shaped folding plates 84 to contact the opposite transverse ends of the belt loop 40 on platform 73 to turn the transverse ends back upon itself. Cam plate 94 continues its forward movement until side rod assembly 96 contacts a stop 104 (FIG. 6) connected to the bottom of plate 80 in its path of movement adjacent one end of groove 98. Continued retraction of piston rod 100 causes slide rod assembly 96 to contact stop 104, which arrests further rotation of the rods 74 and 76. However, the stop 104 is fixed by threaded fasteners 106 to slide plate 80. Upon continued retraction of piston rod 100 and contact of slide rod assembly 96 with stop 104, the slide plate 80 is thrust forward to deliver the folded belt loop 40 beneath the foot 105 of a sewing machine tacker 108 (see phantom lines in FIG. 5).

Figure 3:
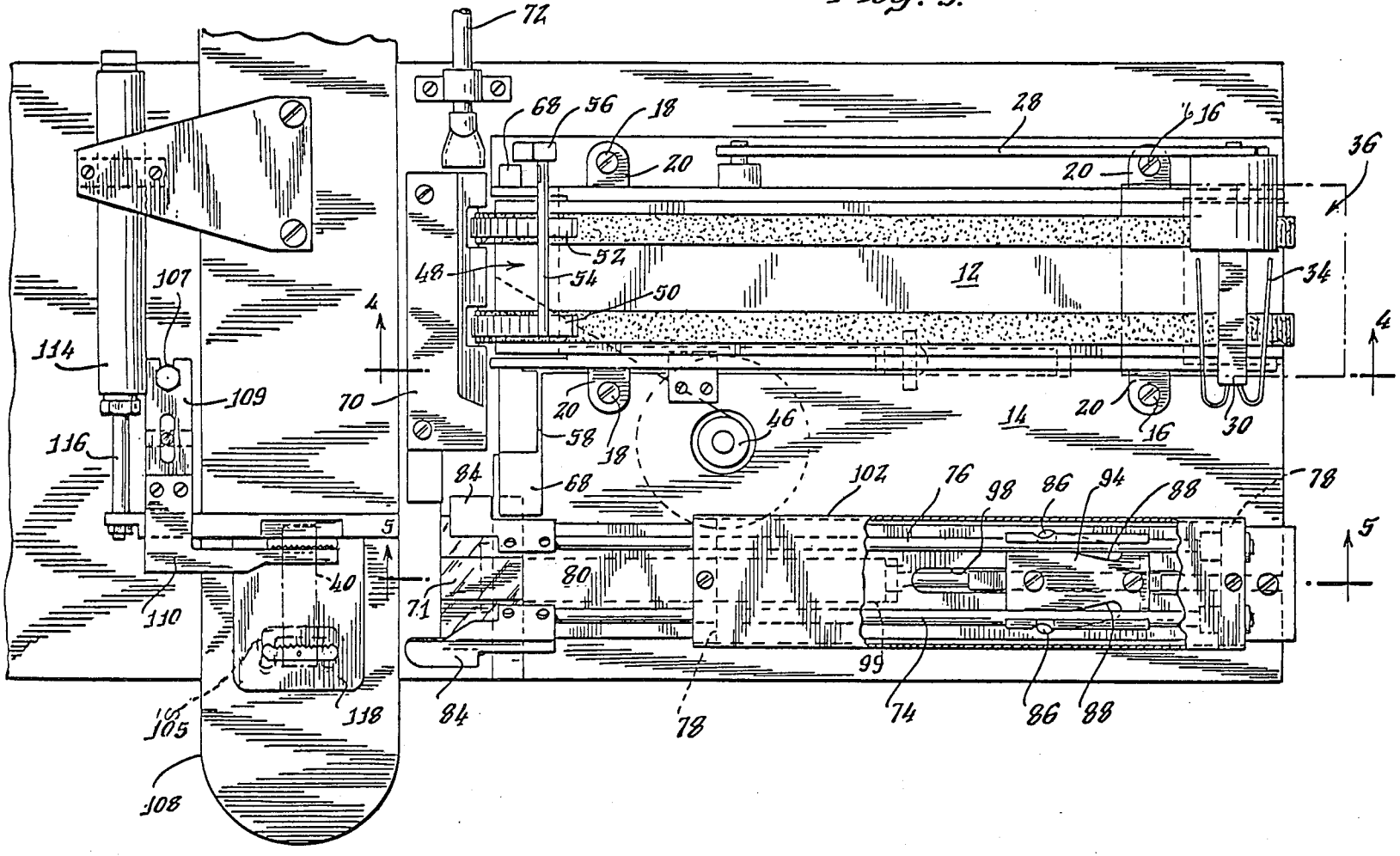
FIG. 3 is a top plan view of the apparatus of FIG. 1.

The motion of the folder mechanism 75 is then reversed. However, prior to the motion being reversed, a vertical air cylinder having a piston 107 connected to a plate 109 fixed to an L-shaped clamp 110 adjacent the foot 105 of the sewing maching tacker 108 is activated to pivot the L-shaped clamp 110 into clamping engagement with the belt loop 40 deposited on platform 118 adjacent sewing machine tacker 108. The L-shaped clamp 110 holds the upper end of the loop. The foot 105 of the tacker 108 descends (see FIG. 3) to hold the lower end of the loop before extension of rod 100.

Once the belt loop 40 is deposited on platform 118 of the sewing machine 108 and clamped by L-shaped plate 110 and the foot 105 of the tacker, piston 100 of air cylinder 98 is extended. Extension of piston 100 causes rods 74 and 76 to first rotate in a counterclockwise and clockwise manner, respectively, as viewed in FIG. 7 to release the folded belt loop 40. This is accomplished by cam plate 94 and slide rod assembly 96 moving to the right as viewed in FIGS. 5 and 6, causing cam plate 94 to move to the right leaving stop 104, while slide plate 80 is stationary. Movement of cam plate 94 to the right will cause relatively stationary cam follower pintles 86 on rods 74, 76 to follow grooves 88 to rotate the downwardly extending folder plates 84 in an opposite manner dropping the folded belt loops on platform 118 of the sewing machine 108. Continued movement of cam plate 94 to the right relative to rods 74, 77 will cause the cam plate 94 to contact a second stop 112 connected to slide plate 80 beneath the opposite end of stop 98, a shown in FIG. 5. Contact of cam plate 94 with the second stop 112 will return slide plate 80 to its initial position upon continued extension of piston 100.

Figure 2:
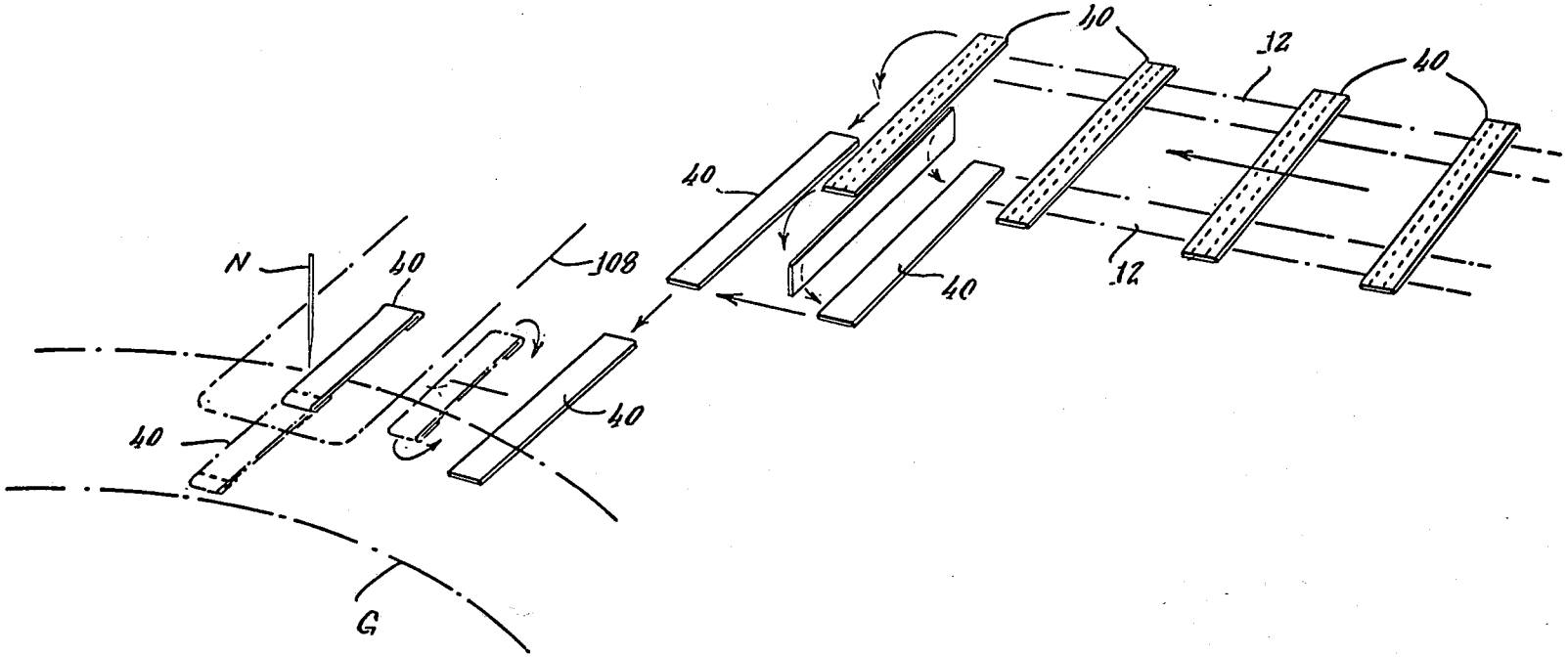
FIG. 2 is a schematic perspective view illustrating the feeding, folding and tacking of a belt loop utilizing the apparatus of FIG. 1.
Figure 5:
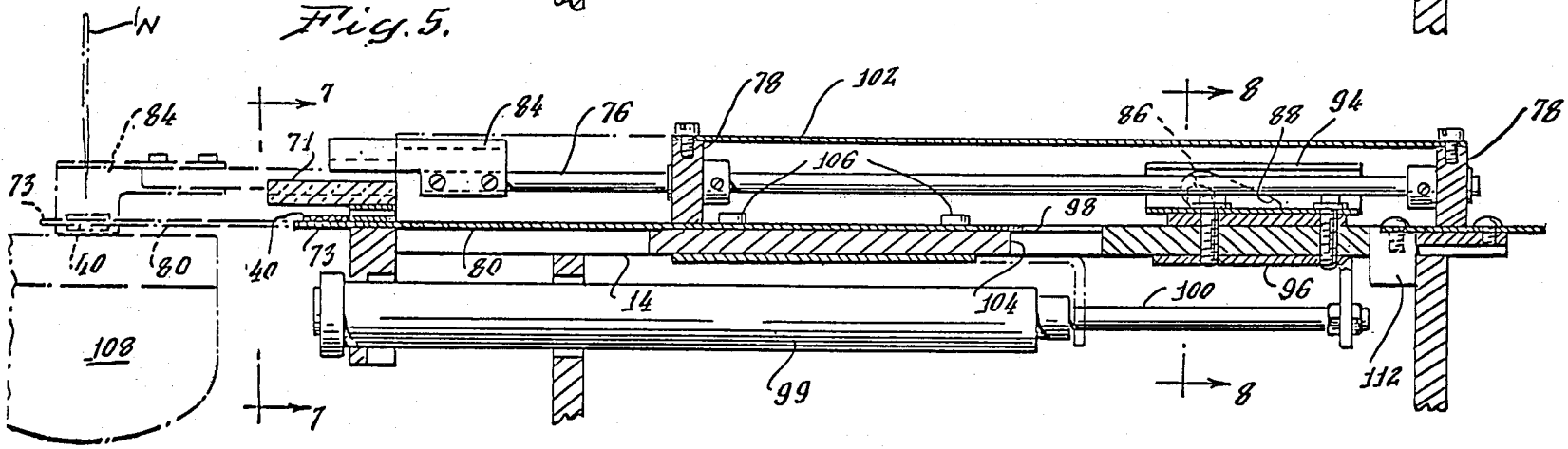
FIG. 5 is a cross-sectional view of the apparatus of the present invention taken substantially along the plane indicated by line 5—5 of FIG. 3.
Figure 6:
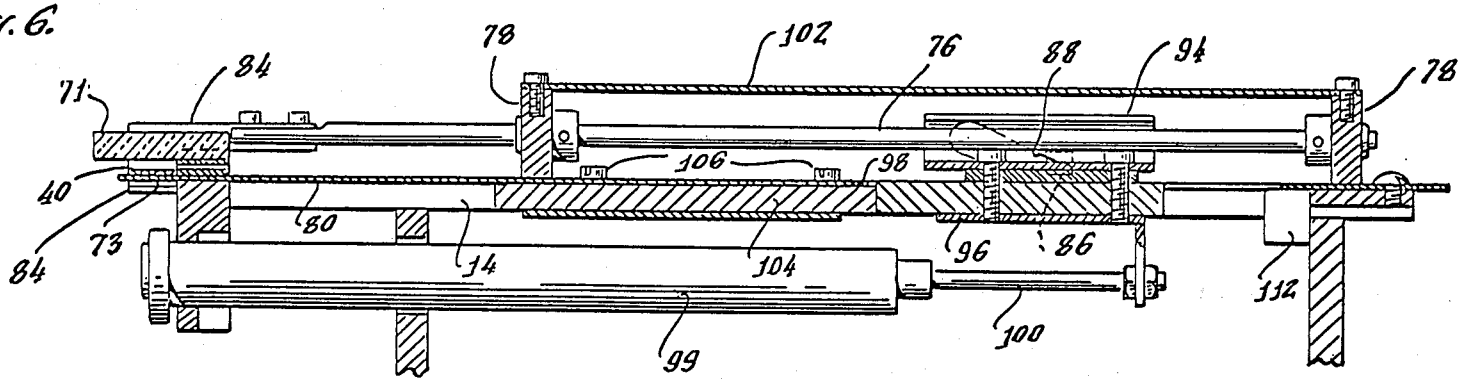
FIG. 6 is a view similar to FIG. 5, but in a different position of operation and use.
Figure 8:
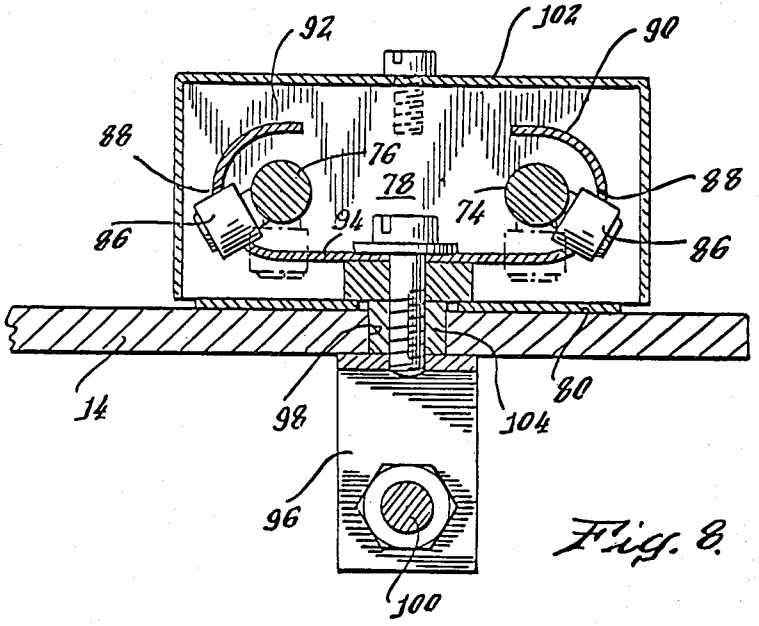
FIG. 8 is a cross-sectional view of the apparatus taken substantially along the plane indicated by line 8—8 of FIG. 5.

With the folded belt loop 40 positioned on platform 118 of the sewing machine 108, the sewing machine needle N is adapted to tack one end of the folded loop 40 to the waist of a garment G draped between platform 118 and loop 40, as indicated in phantom in FIGS. 2 and 5. After tacking the same, the foot 105 is raised and a horizontal air cylinder 114 is activated to extend its piston 116 connected to platform 118. This repositions the opposite transverse end of the loop 40 beneath the needle N of the sewing machine 108 so that it can be tacked to the garment G. Retraction of pistons 116 and 107 and thus, clamp plate 110, enables the garment G to be repositioned by the operator to receive the next loop 40 to be tacked to the garment.

FIG. 2 summarizes the operation and process of the apparatus 10. Belt loops 40 are transported by conveyor belt 12 to L-shaped slide plate 58. Slide plate 58 moves the loops 40 into the enclosure formed by block 70 and L-shaped plate 58 wherein they are blown transversely onto plateform 73 adjacent the folder apparatus. The ends of the belt loop 40 are folded by retraction of piston 100 causing the downwardly extending folder fingers 84 to fold the transverse ends of the loop 40 back upon itself. Slide rod assembly 96 is then moved forwardly to deposit the folded loop 40 on the platform 118 of the sewing machine 108 on the waist portion of garment G. After retraction of plate 80 and counter rotation of fingers 84 to drop loop 40 on platform 118, needle N is activated to tack one end of the folded loop to the garment. The vertical clamp plate 110 holds the loop to the garment after it has been deposited on the platform 118. Horizontal piston 116 is then extended to move the other transverse end of the loop 40 beneath needle N and it is also tacked to the garment.

Figure 10:
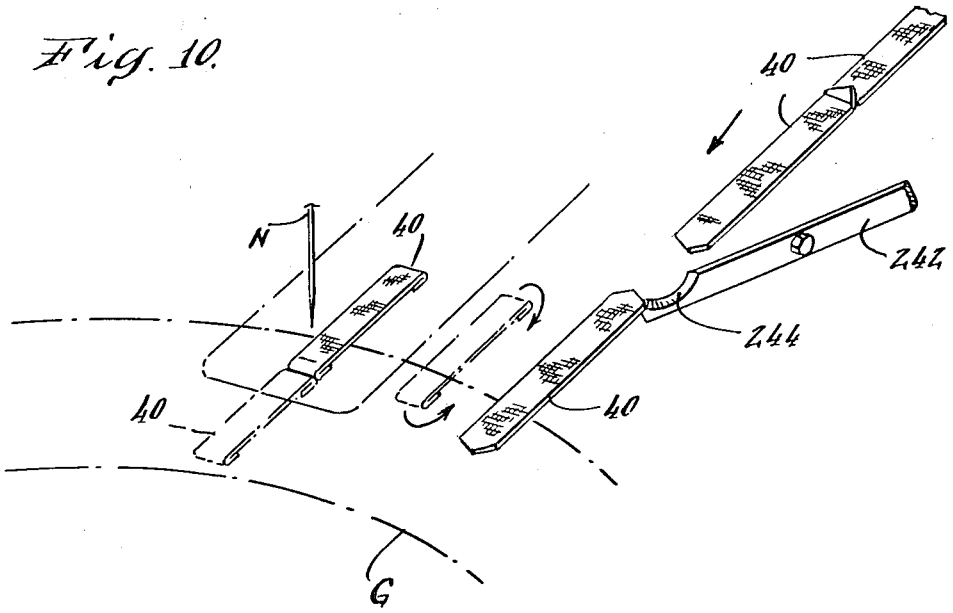
FIG. 10 is a schematic perspective view illustrating the feeding, folding and tacking of a belt loop utilizing the apparatus of FIG. 9.
Figure 11:
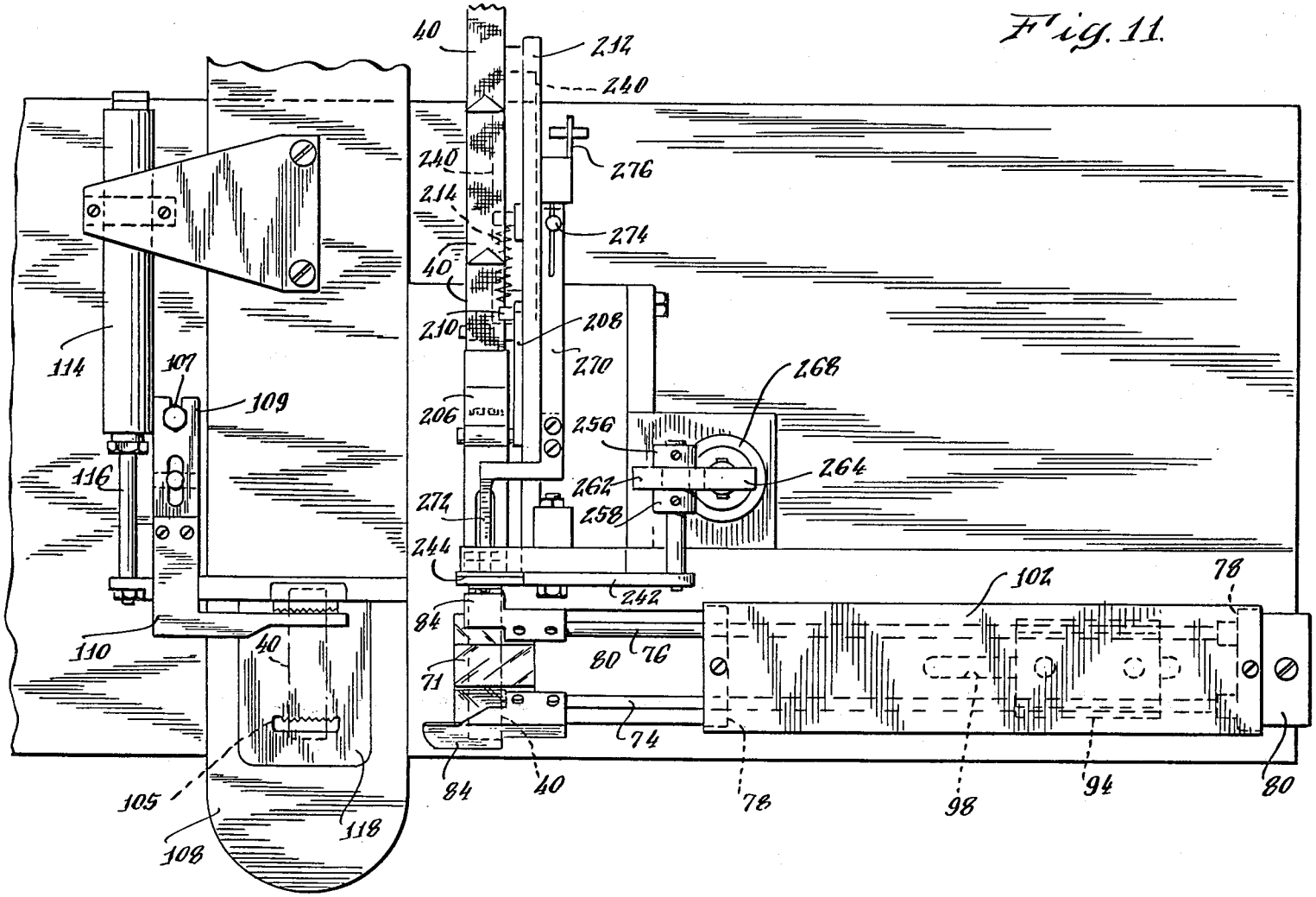
FIG. 11 is a top plan view of the apparatus of FIG. 9.

Alternatively, as shown in FIG. 10, a series of loops 40, overlapped and sewn end-to-end, can be fed by a feed mechanism 200 in stepped increments onto the reciprocable platform 73 on one end of the slidable plate 80 of the folding mechanism 75. The subsequent folding and sewing operations are identical to that described above. FIGS. 9 and 11 to 14 illustrate the operation and structure of feed mechanism 200, in conjunction with the folding and sewing mechanism discussed heretofore, with corresponding structure to that illustrated in the embodiment of the ivnention of FIGS. 1 and 3 to 8 being indicated by the same numbers.

The alternative feeding mechanism 200 includes an endless belt 202 having an upper run 204 in contact with the string of sewn, end-to-end loops 40 which are initially placed manually in contact with the upper run 204 of the belt 202 between the upper run and a spring-biased clamp plate 206. Clamp plate 206 is connected to an end of arm 208 pivoted at 210 to an upright support plate 212. The tension of spring 214 causes arm 208 to pivot about pivot 210 in a clockwise direction as viewed in FIGS. 13 and 14 to clamp the string of loops 40 between the upper run 204 of belt 202 and the lower surface of plate 206.

The belt 202 is entrained about opposed pairs of upper and lower fixed rollers 218, 220 and 222, 224, respectively, provided with one-way clutches (not shown) so that they only turn in the direction of feeding of the belt 202 and belt loops 40.

A pair of movable rollers 226, 228 are in contact with the belt 202 intermediate its upper run 204 and a lower run 230 defined by the opposed pairs of upper and lower rollers 218, 220 and 222, 224, respectively. Each of the movable rollers 226, 228 are mounted on one end of a pivotable arm 232, 234, respectively, which arms are connected by a stiff spring 236 so that they move together in parallel relation.

The opposite end of one of the parallel arms 234 is connected to the piston 238 of an air cylinder 240 mounted on support plate 212. Upon extension of the piston 238 of the air cylinder 240 (FIG. 14), the upper portion of the arms 232, 238 and movable rollers 226, 228 are oscillated in a counterclockwise direction; the movable roller 228 nearest the forward end of the belt 202 about the upper pair of opposed rollers 218, 220 feeds the belt 202 and a belt loop 40 in contact therewith along its length forwardly onto the reciprocable platform 73 on one end of the slidable plate 80 of the folding mechanism 75. Simultaneously, a knife 242 is pivoted to sever the fed loop 40 from the end-to-end string. The knife 242 has a sharpened edge 244 along one end of its upper edge. Edge 244 is adapted to pivot relative to a stationary block 246 above the forward end of clamp plate 206. Block 246 has a complemental knife edge 248. Upon downard movement of the other end of the upper edge of knife 242, the sewn downstream end of a loop 40 advanced to platform 73 sewn to a succeeding loop 40 in the end-to-end string is raised and cut between the movable knife edge 244 and stationary knife edge 248.

Knife 242 is pivoted at 250 to a stationary support 252 and has an end (opposed to the end having sharpened edge 244) connected to a rod 254. Rod 254 is fixed to a pair of rollers 256, 258 having a larger diameter roller shaft 260 therebetween seated in a reverse, C-shaped opening 262 of a bracket 264 connected to the piston 266 of a vertical air cylinder 268 mounted on the frame of the apparatus. Upon retraction of piston 266, bracket arm 264 is pulled downwardly along with roller shaft 260 and rod 254 causing knife 242 to pivot in a clockwise direction in FIG. 9 to sever the sewn end of the belt loop 40. Extension of cylinder 266 repositions the knife 242 and knife edge 244 thereon below stationary knife edge 248. During the movement and the subsequent cutting operation the rearmost movable roller 226 maintains tension in the intermediate portion of the belt 202 as the upper run 204 is fed. The lower run 230 of the endless belt 202 remains stationary as the lower rollers 222, 224 cannot turn in the direction of force applied by the oscillating forward movable roller 228. In essence, therefore, the belt portion between the rear movable roller 226, upper, opposed roller 218, 220 and forward movable roller 228 is moved upon extension of the piston 238.

Upon retraction, or the return stroke of the piston 238 (see FIG. 13), only the lower run 230 of the belt 202 is advanced; the upper run 204 and a subsequent loop 40 to be fed remaining stationary while the loop 40 delivered to the reciprocable feed plate 73 is folded and delivered to the sewing head 108.

Figure 14:
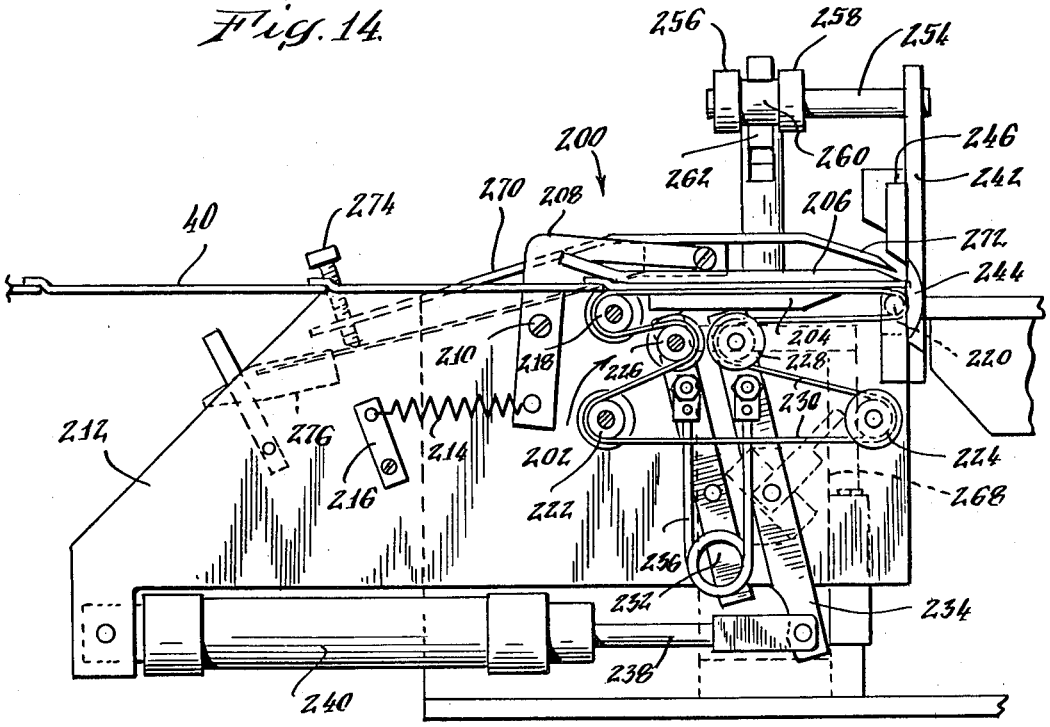
FIG. 14 is a view similar to FIG. 13, but illustrating a different position of operation and use.
Figures 12, 13:
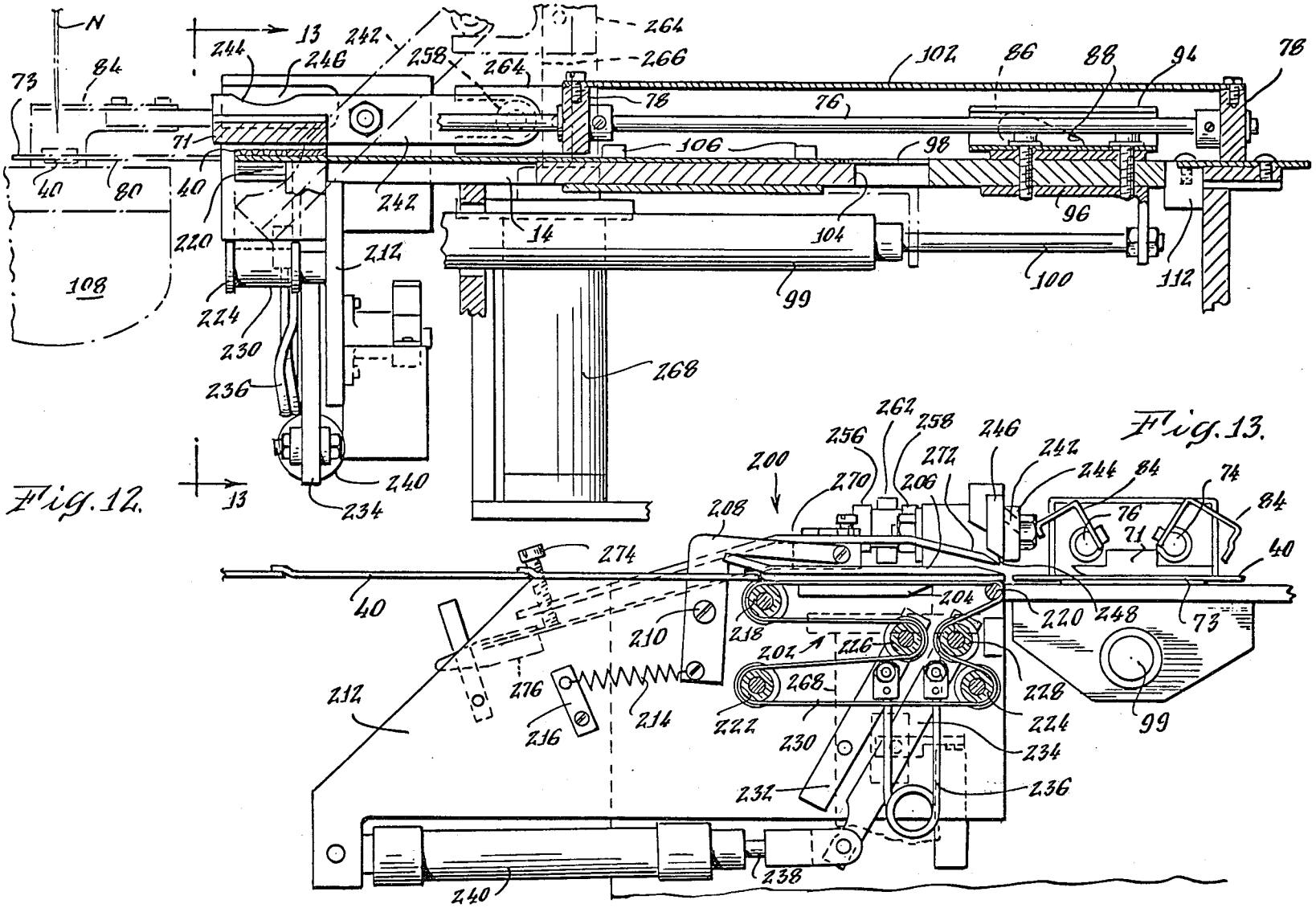
FIG. 12 is a cross-sectional view taken substantially along the plane indicated by line 12—12 of FIG. 9.
FIG. 13 is a cross-sectional view taken substantially along the plane indicated by line 13—13 of FIG. 12.

Upon retraction of the piston 238, the upper portion of the arms 232, 234, are oscillated in a clockwise direction as viewed in FIGS. 13 and 14; the rearmost movable roller 226 pulling the lower run 230 of the belt 202 about the lower pair of opposed, uni-directional turning rollers 222,224. The forward movable roller 228 maintains tension on the intermediate portion of the belt as the lower run 230 is fed. The upper run 204 of the endless belt remains stationary as the opposed pair of upper rollers 218, 220 cannot turn in the direction of force applied by the oscillating rear roller 226. The belt portion between the rear, movable roller 226, the opposed fixed lower rollers 222, 224, and the forward, movable roller 228 is thus only moved upon retraction of the piston 228, providing an effective lost-motion or intermittently operated feed mechanism for the belt loops 40.

The roller and belt feed mechanism 200 enables a positive feed of individual loops to be accomplished, as the upper run 204 of the belt 202 is in full surface contact with each loop 40 along the whole loop surface as it is fed upwardly. Moreover, the mechanism 200 provides a mechanical advantage of 2:1 or one inch of piston movement of piston 238 results in two inches of movement of the upper run 204 of belt 202. This enables the feed apparatus 200 to be more compact as space requirements are severely restricted.

Retraction and extension of piston 238 as well as knife piston 266 can be controlled by an arm, such as arm 270 pivoted on stationary portion of the apparatus, which has a forward portion 272 adjacent the forward end of clamp plate 206. The forward portion 272 of arm 270 is adapted to be contacted by the raised, overlapped portions between the sewn end-to-end loops which pivots the arm 270. A screw member 274 on the rear portion of arm 270 can contact and depress a suitable switch blade 276 to cause air to be vented from cylinder 240 to retract piston 238 and admit air to cylinder 268 to extend piston 266. After a prescribed time period, the pistons are extended and retracted, respectively.

I claim:

1. Apparatus for sewing a belt loop to a garment comprising:

means for intermittently feeding a string of unfolded, end-to-end connected ones of said belt loops onto a support, means for severing individual ones of said loops from said string of loops in response to said loop being fed onto said support.

folding means adjacent said support for folding opposite transverse ends of said severed belt loop back upon itself, and sewing means for tacking a folded belt loop to a garment, said folding means including:

means for reciprocating said folding means to deliver a folded belt loop beneath said sewing means for tacking the folded belt loop to a garment; and said sewing means including:

means for successively positioning the transverse ends of said belt loop beneath said sewing means to that the transverse ends can be sewn to a garment.

2. Apparatus in accordance with claim 1 wherein said intermittent feed means includes:

an endless belt having an upper and lower run, said upper run being in contact with at least one of said belt loops in said string along the entire length thereof, and means for intermittently advancing said upper run of said endless belt towards said support.

3. Apparatus in accordance with claim 2 wherein said intermittent advancement means includes:

a first pair of spaced, uni-directional rotatable rollers receiving the upper run of said endless belt entrained thereabout, a second pair of spaced, uni-directional rotatable rollers receiving the lower run of said endless belt entrained thereabout, a pair of arms connected to move together, each of said arms being pivotably mounted to a support intermediate its ends and having a movable roller mounted on one end thereof in contact with opposed portions of said endless belt intermediate its upper and lower runs, and reciprocable motor means pivotably connected to the other end of one of said arms for oscillating said arms and the rollers mounted thereon to alternately move the upper and lower runs of said endless belt about said first and second pair of uni-directional rollers in response to reciprocation thereof.

4. Apparatus in accordance with claim 3 wherein a spring member connects said arms to each other.

5. Apparatus in accordance with claim 3 wherein said reciprocable motor means includes a fluid cylinder having a piston connected to the other end of one of said arms.

6. Apparatus in accordance with claim 2 including:

a spring-biased clamping plate for holding said belt-loop string on the upper run of said endless belt.

7. Apparatus in accordance with claim 2 wherein said severing means includes:

a pivotable knife between said endless belt and support, and reciprocable motor means pivotably connected to one end of said knife for pivoting said knife in response to the end of the intermittent feeding cycle of said string of belt loops to said support.

8. Apparatus in accordance with claim 1 wherein said folding means includes:

a pair of parallel rods, a folder finger on one end of each of said rods, a reciprocable cam plate, cam follower means between each of said rods and said cam plate for rotating said rods simultaneously in opposite directions about their longitudinal axes to fold opposite transverse ends of said belt loop back upon itself.

9. Apparatus in accordance with claim 1 wherein said sewing means includes:

a platform, means for clamping a folded belt loop on said platform, and means for moving said platform transversely with respect to said sewing means in order to sew opposite transverse ends of a belt loop to a garment.

10. Apparatus in accordance with claim 8 including:

a spiral camming slot on opposite sides of said cam plate, said cam follower means including:

a pintle on each rod received in one of said spiral slots in said cam plate whereby relative movement of said cam plate with respect to said support plate and rods will cause rotation of said rods, and said means for reciprocating said folding means includes:

a reciprocating support plate mounting said parallel rods having an elongated slot therethrough, means mounting said cam plate in said slot for relative movement with respect to said support plate, stop means connected to said support plate adjacent opposite ends of said slot positioned in the path of movement of said cam plate for contact with said cam plate so that continued movement of said cam plate after contact with said stop means causes movement of said support plate, and motor means connected to said cam plate for reciprocably driving said cam plate.

* * * * *